US010125461B1

(12) United States Patent
Alarie

(10) Patent No.: US 10,125,461 B1
(45) Date of Patent: Nov. 13, 2018

(54) LEVERAGE SHOVEL

(71) Applicant: J Brian Alarie, Worcester, MA (US)

(72) Inventor: J Brian Alarie, Worcester, MA (US)

( * ) Notice: Subject to any disclaimer, the term of this patent is extended or adjusted under 35 U.S.C. 154(b) by 0 days.

(21) Appl. No.: 15/887,155

(22) Filed: Feb. 2, 2018

Related U.S. Application Data

(60) Provisional application No. 62/567,453, filed on Oct. 3, 2017.

(51) Int. Cl.

| | |
|---|---|
| ***E01H 5/02*** | (2006.01) |
| ***B25G 1/04*** | (2006.01) |
| ***B25G 1/10*** | (2006.01) |
| *B25G 3/12* | (2006.01) |

(52) U.S. Cl.
CPC ..... *E01H 5/02* (2013.01); *B25G 1/04* (2013.01); *B25G 1/102* (2013.01); *B25G 3/12* (2013.01)

(58) Field of Classification Search
CPC .. E01H 5/02; A01B 1/02; A01B 1/026; B25G 3/10; B25G 1/04; B25G 1/102; B25G 3/12
See application file for complete search history.

(56) References Cited

U.S. PATENT DOCUMENTS

| | | | | |
|---|---|---|---|---|
| 4,050,728 | A * | 9/1977 | Davidson | A01B 1/026 16/426 |
| 5,419,600 | A * | 5/1995 | Tisbo | E01H 5/02 294/54.5 |
| 5,921,600 | A * | 7/1999 | Lucas | A01B 1/026 294/58 |
| 2010/0109358 | A1* | 5/2010 | Burke | B25G 3/38 294/58 |
| 2014/0132015 | A1* | 5/2014 | Stachowski | A01B 1/026 294/51 |
| 2015/0195985 | A1* | 7/2015 | Gershman | A01B 1/028 254/131.5 |
| 2015/0201542 | A1* | 7/2015 | Thresher | E01H 5/02 294/58 |

* cited by examiner

*Primary Examiner* — Stephen A Vu

(57) ABSTRACT

A leverage snow shovel includes a scoop, a straight leverage handle, a first grip, a bent handle, a second grip, and a spacer. A fixed end of the straight leverage handle and a fixed end of the bent handle are terminally connected to each other so that the scoop can be mounted to the both handles about the fixed ends. The spacer is connected in between the straight leverage handle and the bent handle separating a free end of the straight leverage handle away from a free end of the bent handle. The first grip is terminally mounted to the free end of the straight leverage handle through a height adjustable mechanism, and the second grip is terminally connected to the free end of the bent handle. The two handles are then able to maximize the lifting power of the leverage snow shovel without bending a user's back or knees.

6 Claims, 6 Drawing Sheets

LEVERAGE SHOVEL

The current application claims a priority to the U.S. Provisional Patent application Ser. No. 62/567,453 filed on Oct. 3, 2017.

FIELD OF THE INVENTION

The present invention relates generally to a shovel. More specifically, the present invention is a leverage shovel that enables the user to achieve maximum leverage and maintain a straighter back during the process of moving snow or other material.

BACKGROUND OF THE INVENTION

A shovel is a tool for digging, lifting, and moving bulk materials such as soil, coal, gravel, sand, or snow. Most of the shovels are hand tools consisting of a broad scoop fixed to a handle. Even though the type of scoop depends upon the type of bulk material that the shovel is utilized, the handle can be categorized into three different types. For example, a snow shovel handle can be either a straight handle, a bent handle, and combination of long handle and short handle. The oldest shovel design is the straight handle. But, the straight handle is by far the worst shovel for user's back since there is virtually no leverage as the strain on the back is obvious after hours of work. The bent handle increases the leverage in comparison to the straight handle. However, when the scoop is loaded with snow and picked up by the user, the snow would begin to fall out due to the angle of the scoop. As a result, users have to bend down or bend one's knees to keep the snow on the scoop thus providing stain on their back and knees. The combination of a long handle and short handle provides better leverage compared to straight handle or the bent handle since users are not bending the back much. But after a little while, users begin to feel aggravated muscles that were never really utilized within daily activities. The extra handle, the short front handle, which is positioned halfway up the main handle provides some leverage and causes more work for the muscles. Plus, users have to bend down or bend their knees to keep the snow from falling out thus providing strain on their back and knees.

It is therefore an objective of the present invention to maximum leverage while lifting snow by any person of height, while maintaining a straight back and putting back strain to a bare minimum and pushing through hard snow easier. More specifically, a scoop of the present invention is removably mounted to a straight leverage handle and a bent handle of the present invention that are manufactured into the singular body. The straight leverage handle provides great pushing and pulling power and chomping power to separate snow easier and is primarily used for the lifting power of the scoop. The bent handle is primarily used for keeping the user's back straight when lifting and brings the user a little closer to the scoop thus providing guidance and stability. The straight leverage handle improves the leverage by lifting the scoop as close as possible to the user through the handle grip of the straight leverage handle. As a result, the present invention creates a unique shovel that makes it easier for snow collecting and lifting while maintaining a straight back with less chance of a pulled muscle, tendon, or a spine injury.

DETAIL DESCRIPTIONS OF THE INVENTION

All illustrations of the drawings are for the purpose of describing selected versions of the present invention and are not intended to limit the scope of the present invention.

Figure 1:
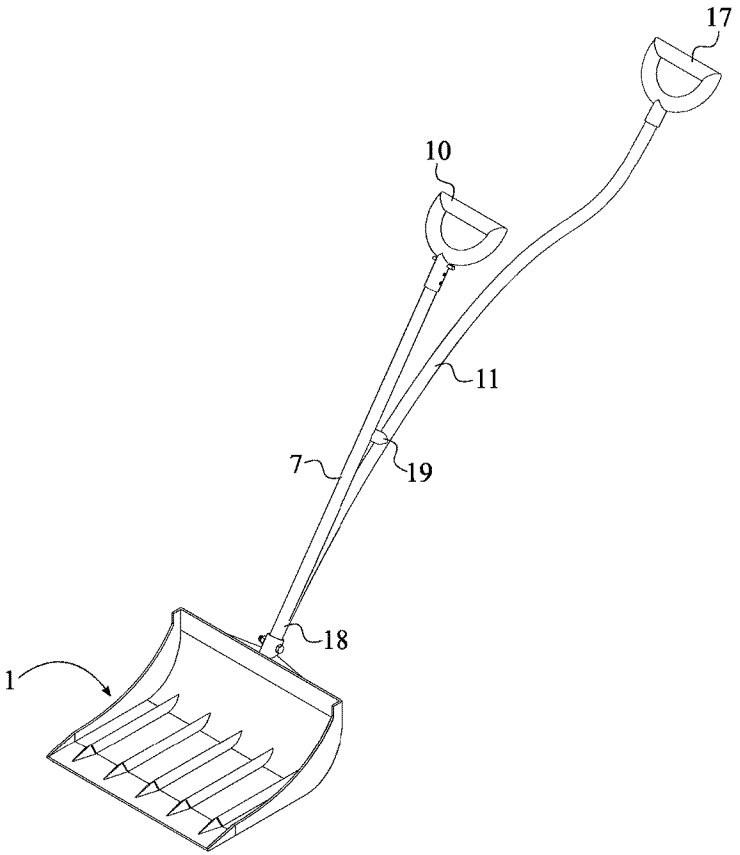
FIG. 1 is a perspective view of the present invention.
Figure 2:
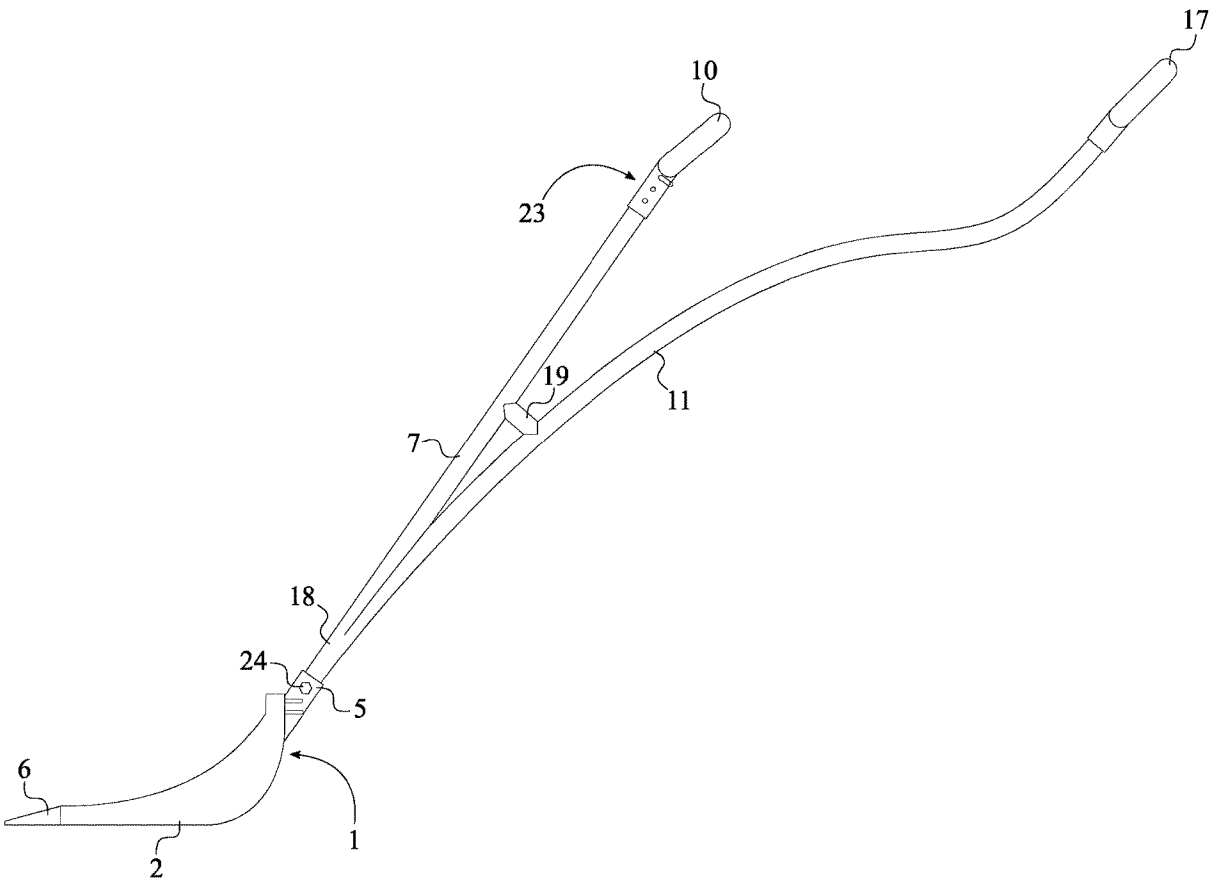
FIG. 2 is a side view of the present invention.

The present invention is a leverage snow shovel that utilizes two separate handles to pick up and move snow. More specifically, the separate handles of the present invention maximize the lifting power of the snow without bending a user's back or knees. At the same time, the present invention is able to maintain benefits and advantages of the existing snow shovels. The present invention comprises a scoop 1, a straight leverage handle 7, a first grip 10, a bent handle 11, a second grip 17, and a spacer 19 as shown in FIG. 1-2. In reference to the general configuration of the present invention, a fixed end 8 of the straight leverage handle 7 and a fixed end 12 of the bent handle 11 are terminally connected to each other at a connector joint 18. The spacer 19 is connected in between the straight leverage handle 7 and the bent handle 11 so that both handles can be separated from each other, opposite from the fixed end 8 of the straight leverage handle 7 and the fixed end 12 of the bent handle 11. Due to the separation of the straight leverage handle 7 and the bent handle 11, the first grip 10 is terminally mounted to a free end 9 of the straight leverage handle 7, and the second grip 17 is terminally mounted to a free end 13 of the bent handle 11. The connector joint 18, which is delineated by the connection of the fixed end 8 of the straight leverage handle 7 and the fixed end 12 of the bent handle 11, is concentrically mounted within a collar 5 of the scoop 1 thus completing the general configuration of the present invention.

The scoop 1 functions similar to existing shovel heads so that snow can be collected within the present invention. In reference to FIG. 3-6, the scoop 1 further comprises a blade 2 and an edge strip 6 in addition to the collar 5 as the edge strip 6 and the collar 5 are oppositely positioned of each other about the blade 2. The blade 2 provides the surface area for snow to be collected within the present invention. Furthermore, the blade 2 comprises a plurality of ridges that extends from a front end 3 of the blade 2 to a rear end 4 of the blade 2. The plurality of ridges helps to break apart the snow when the snow is collected within the scoop 1. The collar 5 is a cylindrical sleeve body and adjacently connected to the rear end 4 of the blade 2 so that the connector joint 18 can be inserted into the collar 5. More specifically, the collar 5 is angularly positioned with a bottom flat surface of the front end 3 as the angled between the collar 5 and the bottom flat surface is an acute angle. In order to withstand the weight of the collected snow and improve the structural integrity between the scoop 1 and the connector joint 18, additional supporting plates can be connected between the collar 5 and the rear end 4 within the present invention. The edge strip 6 provides the initial contact with snow when the present invention is utilized and tends to wear out overtime. As a result, the edge strip 6 is removably mounted to the front end 3. More specifically, the edge strip 6 is removably mounted to the front end 3 by the plurality of fasteners 20 so that the edge strip 6 can be removed and replaced when necessary. Each of the plurality of fasteners 20 is aligned along and within the plurality of ridges so that connecting points between the edge strip 6 and the front end 3 can be hidden within the plurality of ridges of the scoop 1. Since the plurality of fasteners 20 is positioned atop the bottom flat surface of the front end 3, the present invention minimizes contact points between the plurality of fasteners 20 and the ground surface thus improving the reliability of the plurality of fasteners 20.

Figure 7:
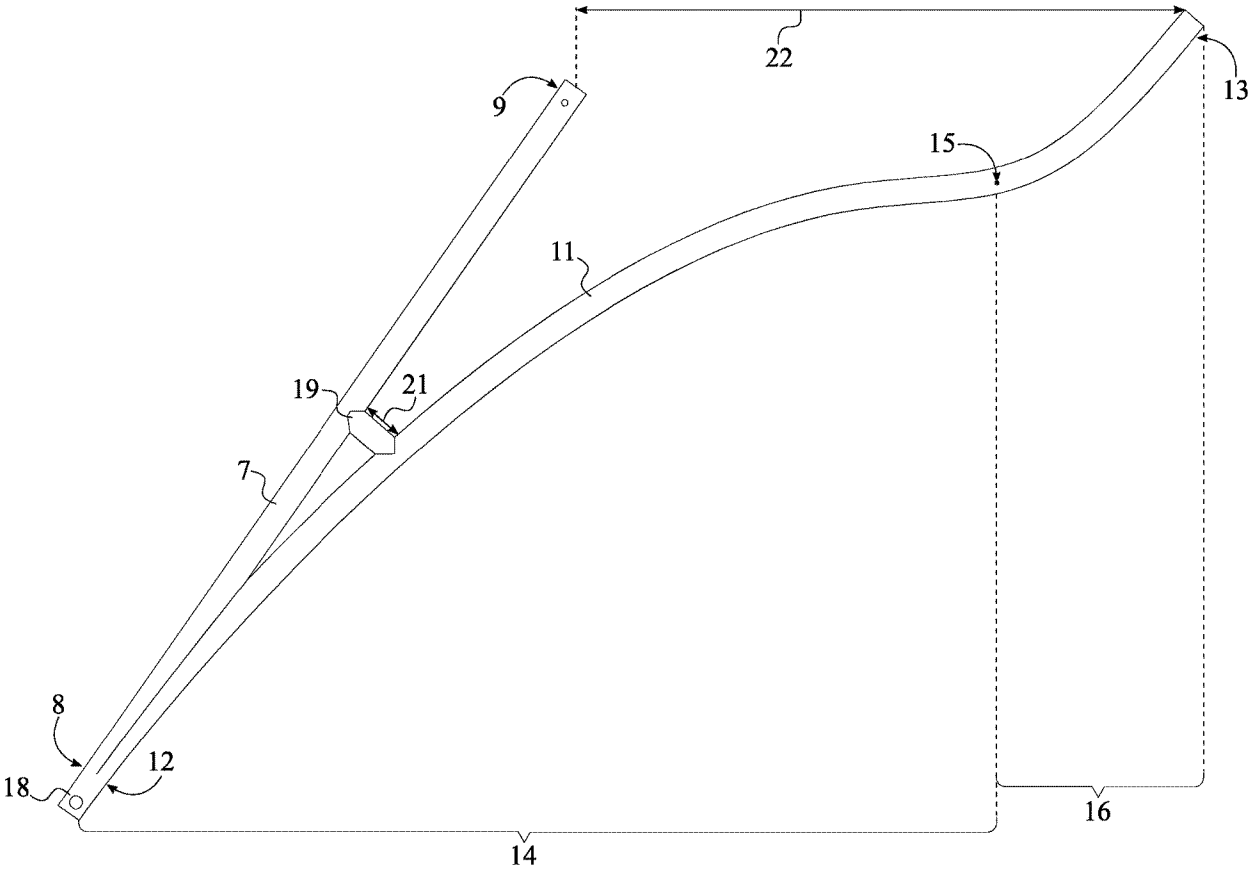
FIG. 7 is a side view of the straight leverage handle and the bent handle, showing the spacer length along the spacer and the linear handle distance between the free ends of the straight leverage handle and the bent handle.

The spacer 19 separates the free end 9 of the straight leverage handle 7 and the free end 13 of the bent handle 11 away from each other as the straight leverage handle 7 and the bent handle 11 have to be pushed apart from one another due to the connector joint 18. In reference to FIG. 7, a spacer length 21 is delineated between the straight leverage handle 7 and the bent handle 11 along the spacer 19. A linear handle distance 22 is delineated between the free end 9 of the straight leverage handle 7 and the free end 13 of the bent handle 11. In order to provide the optimal clearance between free end 9 of the straight leverage handle 7 and the free end 13 of the bent handle 11, a ratio between the spacer length 21 and the linear handle distance 22 is approximately 1:5 within the present invention. In an alternative embodiment of the present invention, the spacer 19 can function as a fulcrum between the straight leverage handle 7 and the bent handle 11 along with a locking mechanism so that the straight leverage handle 7 and the bent handle 11 can be folded and locked for vertically storage or extended and locked for usage.

The first grip 10 and the second grip 17 provide means to securely hold and operate the straight leverage handle 7 and the bent handle 11 within the present invention. The first grip 10 and the second grip 17 each comprise a gripping section and a connector section. The gripping section provides the surface area to grasp the first grip 10 and the second grip 17 as the connector section is terminally connected to the gripping section. The connector section is a cylindrical sleeve body and allows the free end 9 of the straight leverage handle 7 or the free end 13 of the bent handle 11 to be inserted thus completing the respective connections between the first grip 10 and the straight leverage handle 7 and the second grip 17 and the bent handle 11. In reference to FIG. 3, the first grip 10 is mounted to the free end 9 of the straight leverage handle 7 by a height adjustable mechanism 23 while the second grip 17 and the free end 13 of the bent handle 11 are connected through a fixed connection. The height adjustable mechanism 23 enables the user to change the total height of the straight leverage handle 7 and the first grip 10, which is positioned normal to the ground surface, so that the user is able to attain a comfortable height for the straight leverage handle 7 and the first grip 10 upon user's preference.

In reference to a preferred embodiment of the height adjustable mechanism 23, the height adjustable mechanism 23 comprises a handle opening, a plurality of connector openings, and a locking pin. More specifically, the handle opening traverses through the free end 9 of the straight leverage handle 7. The plurality of connector openings is linearly distributed and traverses along the connector section of the first grip 10. As the first grip 10 is inserted around the free end 9 of the straight leverage handle 7, each connector opening can be concentrically aligned with the handle opening in order to attain different height adjustments between the straight leverage handle 7 and the first grip 10. Once the correct height adjustment is accomplished with the alignment of the handle opening and a corresponding opening of the plurality of connector openings, the locking pin can be inserted into the corresponding opening and the handle opening thus securing the first grip 10 to the straight leverage handle 7. Even though the preferred embodiment of the height adjustable mechanism 23 is explained with respect to the present invention, the present invention is not limited the preferred embodiment of the height adjustable mechanism 23 and can include any other types of height regulating mechanisms that provide the same functionality.

The straight leverage handle 7 allows the user to collect and lift snow within the scoop 1 while the bent handle 11 provides support for the actual process of shoveling snow. In reference to FIG. 7, the bent handle 11 further comprises a concave down section 14, an inflection point 15, and a concave up section 16. The concave down section 14 is extended upward from the fixed end 12 of the bent handle 11 to the inflection point 15, and the concave up section 16 is extended downward from the free end 13 of the bent handle 11 to the inflection point 15. In other words, the fixed end 12 of the bent handle 11 extends into the free end 13 of the bent handle 11 through the concave down section 14 and the concave up section 16 as the overall profile for the concavity changes about the inflection point 15. In reference to a preferred embodiment of the bent handle 11, the concave down section 14 is about 23 inches in a horizontal distance and about 24 inches in a vertical height to the inflection point 15. The concave up section 16 is about 3 inches in a horizontal distance and about 6 inches in a vertical height from the inflection point 15.

Figure 3:
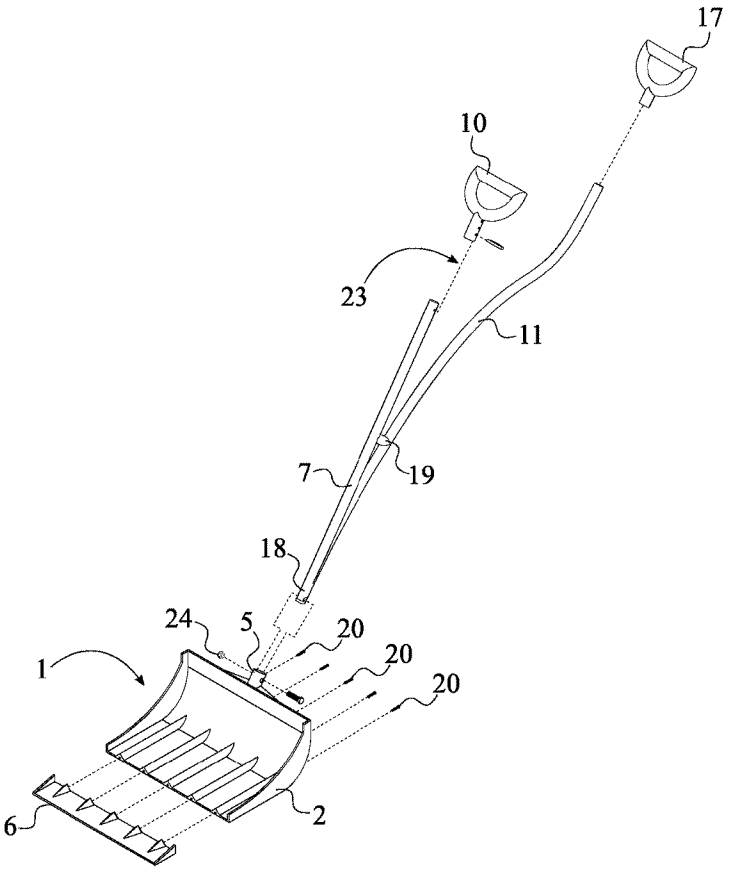
FIG. 3 is a perspective exploded view of the present invention, wherein the dash-lines showing the connection between the bent handle and the second grip, attachment between the connector joint and the collar through the fastener, and the attachment between the blade and the edge strip by the plurality of fasteners.
Figure 5:
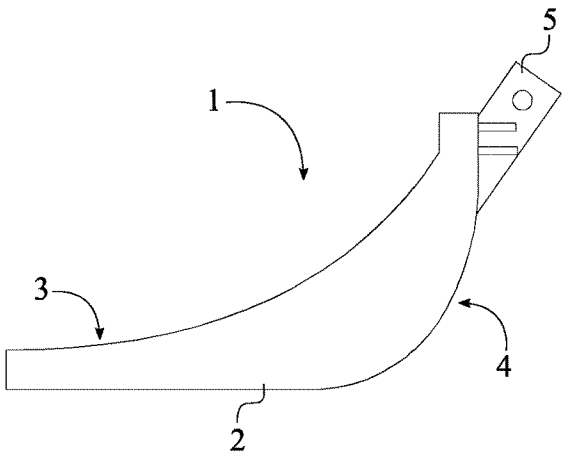
FIG. 5 is a side view of the blade of the present invention.
Figure 4:
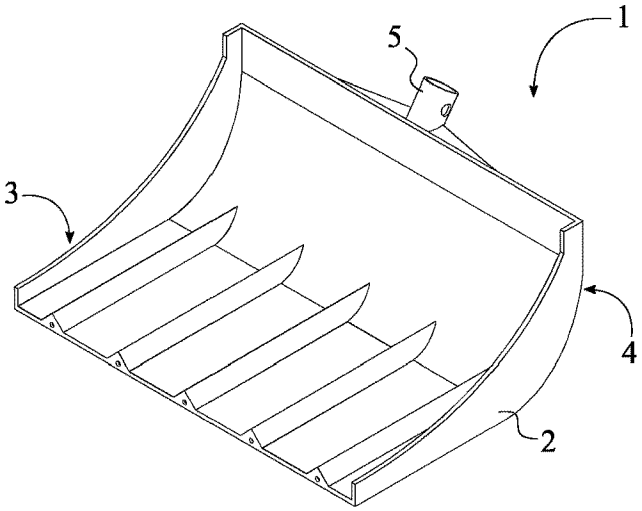
FIG. 4 is a front perspective view of the blade of the present invention.
Figure 6:
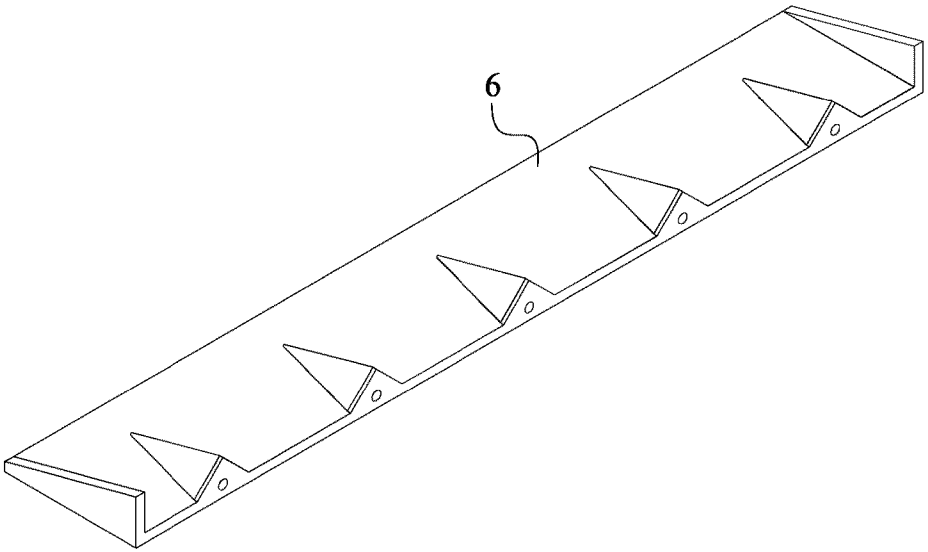
FIG. 6 is a rear perspective of the edge strip of the present invention.

In reference to FIG. 2-3, the connector joint 18 and the collar 5 are mounted to each other by a fastener 24 so that the scoop 1 can be detached when necessary. As a result, the connector joint 18 can be interchanged with multiple scoops that are different in width, different in shape, or different in material. Additionally, when an old scoop is worn out and unusable, the worn-out scoop can be changed into a new scoop through the fastener 24. The fastener 24 can include, but is not limited to, a screw fastener, a male and female treaded fastener, a clamp fastener, a snap fastener, and a latch fastener 4.

As a result of the configuration between the scoop 1, the straight leverage handle 7, and the bent handle 11, the present invention minimizes back injury for users, maintains a better cardio workout for users, and maintains less stressful movements for users during usage. More specifically, the straight leverage handle 7 provides great pushing and pulling power and chomping power to separate snow easier and is primarily used as lifting power of the scoop 1. The bent handle 11 is primarily used for keeping the user's back straight when lifting and brings the user a little closer to the scoop 1 thus providing guidance and stability. The straight leverage handle 7 improves the leverage by lifting the scoop 1 as close as possible to the user through the first grip 10 and the straight leverage handle 7. Furthermore, the present invention improves upon existing snow shovels by combining the functionality of replaceable edge strip 6, replaceable scoop 1, height adjustable first grip 10, and the straight leverage handle 7 and the bent handle 11.

Although the invention has been explained in relation to its preferred embodiment, it is to be understood that many other possible modifications and variations can be made without departing from the spirit and scope of the invention as hereinafter claimed.

What is claimed is:

1. A leverage snow shovel comprises:

a scoop;

a straight leverage handle;

a first grip;

a bent handle;

a second grip;

a spacer;

a fixed end of the straight leverage handle and a fixed end of the bent handle being terminally connected to each other at a connector joint;

the spacer being connected in between the straight leverage handle and the bent handle;

the first grip being terminally mounted to a free end of the straight leverage handle;

the second grip being terminally mounted to a free end of the bent handle;

the connector joint being concentrically mounted within a collar of the scoop;

the bent handle comprising a concave down section, an inflection point and a concave up section;

the concave down section being extended from the fixed end of the bent handle to the inflection point; and the concave up section being extended from the free end of the bent handle to the inflection point.

2. The leverage snow shovel as claimed in claim 1 comprises:

the scoop further comprises a blade and an edge strip;

the edge strip and the collar being oppositely positioned of each other about the blade;

the edge strip being removably mounted to a front end of the blade; and the collar being adjacently connected to a rear end of the blade.

3. The leverage snow shovel as claimed in claim 2 comprises:

a plurality of fasteners; and the edge strip being removably mounted to the front end of the blade by the plurality of fasteners.

4. The leverage snow shovel as claimed in claim 1 comprises:

a spacer length;

a linear handle distance;

the spacer length being delineated between the straight leverage handle and the bent handle along the spacer;

the linear handle distance being delineated between the free end of the straight leverage handle and the free end of the bent handle; and a ratio between the spacer length and the linear handle distance being approximately 1:5.

5. The leverage snow shovel as claimed in claim 1, wherein the first grip is mounted to the free end of the straight leverage handle by a height adjustable mechanism.

6. The leverage snow shovel as claimed in claim 1 comprises:

a fastener; and the connector joint and the collar being mounted to each other by the fastener.

* * * * *